US006701925B1

(12) United States Patent
Resnick

(10) Patent No.: US 6,701,925 B1
(45) Date of Patent: Mar. 9, 2004

(54) PROTECTIVE HOOD RESPIRATOR

(76) Inventor: Todd A. Resnick, P.O. Box 1559, Stuart, FL (US) 34995-1559

( * ) Notice: Subject to any disclaimer, the term of this patent is extended or adjusted under 35 U.S.C. 154(b) by 0 days.

(21) Appl. No.: 10/063,328

(22) Filed: Apr. 11, 2002

(51) Int. Cl.[7] ..... A62B 18/08; A62B 19/00

(52) U.S. Cl. ..... 128/206.17; 128/201.22; 128/201.29; 128/205.27; 128/205.29; 128/205.25

(58) Field of Search ..... 128/201.15, 306.28, 128/206.28, 201.22, 201.29, 202.11, 201.24, 205.25, 206.17, 205.27, 205.29

(56) References Cited

U.S. PATENT DOCUMENTS

| | | | |
|---|---|---|---|
| 476,486 | A | 6/1892 | Pozdena |
| 706,015 | A | 8/1902 | Breen |
| 1,048,135 | A | 12/1912 | Cloetta et al. |
| 1,317,947 | A | 10/1919 | Soderling |
| 1,410,928 | A | 3/1922 | Knoblock |
| 1,453,365 | A | 5/1923 | Malcom |
| 1,488,970 | A | 4/1924 | Bell |
| 1,491,674 | A | 4/1924 | Coletti |
| 1,679,839 | A | 8/1928 | Mitchell |
| 1,710,160 | A | 4/1929 | Gibbs |
| 1,730,227 | A | 10/1929 | McBride |
| 1,789,262 | A | 1/1931 | Monro et al. |
| 1,821,996 | A | 9/1931 | Willson |
| 1,843,446 | A | 2/1932 | Drager |
| 1,963,874 | A | 6/1934 | Stampe |
| 2,000,064 | A | 5/1935 | Cover |
| 2,019,928 | A | 11/1935 | Punton et al. |
| 2,035,097 | A | 3/1936 | Schwartz |
| 2,053,896 | A | 9/1936 | Cover |
| 2,055,853 | A | 9/1936 | Schwartz |
| 2,065,304 | A | 12/1936 | Cover |
| 2,067,822 | A | 1/1937 | Biederman |
| 2,070,241 | A | 2/1937 | Schwartz |
| 2,106,795 | A | 2/1938 | Cover |
| 2,111,995 | A | 3/1938 | Schwartz |
| 2,112,270 | A | 3/1938 | Cover |
| 2,115,946 | A | 5/1938 | Eaton |
| 2,120,230 | A | 6/1938 | Cover |
| 2,120,231 | A | 6/1938 | Cover |
| 2,122,111 | A | 6/1938 | Poelman et al. |
| 2,139,137 | A | 12/1938 | Schwartz |
| 2,153,437 | A | 4/1939 | Schwartz |
| 2,195,563 | A | 4/1940 | Granger Fils |
| 2,199,230 | A | 4/1940 | Schwartz |
| 2,199,231 | A | 4/1940 | Schwartz |
| 2,201,315 | A | 5/1940 | Lehmberg |
| 2,213,433 | A | 9/1940 | Punton |
| 2,227,959 | A | 1/1941 | Cover |
| 2,235,624 | A | 3/1941 | Schwartz |
| 2,238,964 | A | 4/1941 | Benos |
| 2,261,362 | A | 11/1941 | Gill |
| 2,264,829 | A | 12/1941 | Cover |
| 2,295,119 | A | 9/1942 | Malcom et al. |
| 2,295,296 | A | 9/1942 | Schmidt |
| 2,312,714 | A | 3/1943 | Herbin |
| 2,337,232 | A | 12/1943 | Daly |
| 2,435,721 | A | 2/1948 | Lehmann |
| 2,505,173 | A | 4/1950 | Conley |
| 2,534,720 | A | 12/1950 | Loose |

(List continued on next page.)

*Primary Examiner*—Weilun Lo
*Assistant Examiner*—Darwin P. Erezo
(74) *Attorney, Agent, or Firm*—Smith & Hopen, P.A.; Anton J. Hopen

(57) ABSTRACT

The present invention is a protective respiratory apparatus including a neck-sealable hood adapted to enclose the head of a wearer, the hood having an interior and exterior, two filters sealingly secured in symmetrical relation to the hood wherein air passing from the outside of the hood to the inside of the hood is filtered of contaminants, a half-mask cup inside the hood, the cup adapted to sealingly cover the nose and mouth of the wearer, the cup mechanically, but not fluidly coupled to the two filters, and at least one air intake valve in the cup wherein filtered air resident in the interior of the hood is drawn into the half-mask cup for respiration by the wearer.

13 Claims, 12 Drawing Sheets

U.S. PATENT DOCUMENTS 2,578,007 A 12/1951 Hill
2,652,828 A 9/1953 Matheson
2,664,887 A 1/1954 Green
2,668,532 A 2/1954 Evans
2,706,983 A 4/1955 Matheson et al.
2,740,400 A 4/1956 Wines
2,744,523 A 5/1956 Malcom, Jr. et al.
2,744,524 A 5/1956 Whipple
2,744,525 A 5/1956 Whipple
2,751,904 A 6/1956 Lewis
2,791,216 A 5/1957 Churchill et al.
2,823,671 A 2/1958 Garelick
2,845,926 A 8/1958 Hill
2,845,927 A 8/1958 Hill
2,894,508 A 7/1959 Miles et al.
2,898,908 A 8/1959 Sovinsky
3,018,776 A 1/1962 Saitta et al.
3,072,119 A 1/1963 Matheson
3,118,445 A 1/1964 Norman
3,142,549 A 7/1964 Klusewitz et al.
3,161,491 A 12/1964 Gongoll et al.
3,216,415 A 11/1965 Littleton
3,249,106 A 5/1966 Motsinger
3,307,543 A 3/1967 Silverman
4,088,461 A 5/1978 Brauer
4,154,586 A 5/1979 Jones et al.
4,179,274 A 12/1979 Moon
4,294,599 A 10/1981 Grovesteen et al.
D262,322 S 12/1981 Mizerak
4,304,230 A 12/1981 Seufert
4,334,901 A 6/1982 Ayes et al.
4,414,973 A 11/1983 Matheson et al.
4,453,544 A 6/1984 Silverthorn
4,467,795 A 8/1984 Eckstein
4,501,272 A 2/1985 Shigematsu et al.
4,505,310 A * 3/1985 Schneider ..... 128/206.22
4,520,509 A 6/1985 Ward
4,548,626 A 10/1985 Ackley et al.
4,549,543 A 10/1985 Moon
4,562,837 A 1/1986 Schlobohm
4,573,464 A 3/1986 Yo
4,579,113 A 4/1986 McCreadie et al.
4,592,350 A 6/1986 Maryyanek et al.
4,595,003 A 6/1986 Shoemaker et al.
4,628,927 A 12/1986 Ward
4,630,604 A 12/1986 Montesi
4,674,492 A 6/1987 Niemeyer
4,677,976 A 7/1987 Fujinuma et al.
4,686,976 A 8/1987 Bakkila et al.
4,688,567 A 8/1987 Kikuchi et al.
4,714,486 A 12/1987 Silverthorn
4,771,771 A 9/1988 Walther
4,793,342 A 12/1988 Haber et al.
4,807,614 A * 2/1989 van der Smissen et al. ..... 128/201.23
4,832,011 A * 5/1989 Busch ..... 128/201.23
4,832,018 A 5/1989 Pantaleon-Stemberg
4,850,346 A 7/1989 Michel et al.
4,856,508 A 8/1989 Tayebi
4,865,637 A 9/1989 Gruber
4,881,538 A 11/1989 Angell
4,886,058 A 12/1989 Brostrom et al.
4,932,399 A 6/1990 Cappa et al.
4,934,361 A 6/1990 Michel et al.
4,945,907 A 8/1990 Tayebi
4,961,420 A 10/1990 Cappa et al.
5,018,518 A 5/1991 Hubner
5,033,507 A 7/1991 Pouchot
5,036,844 A 8/1991 Pouchot et al.
5,062,421 A 11/1991 Burns et al.
5,063,926 A 11/1991 Forsgren et al.
5,069,205 A 12/1991 Urso
5,086,768 A 2/1992 Niemeyer
5,104,430 A 4/1992 Her-Mou
5,140,980 A 8/1992 Haughey et al.
5,148,803 A 9/1992 Schlobohm
5,181,507 A 1/1993 Michel et al.
5,222,488 A 6/1993 Forsgren
5,224,473 A 7/1993 Bloomfield
5,224,474 A 7/1993 Bloomfield
5,297,544 A * 3/1994 May et al. ..... 128/202.22
5,303,701 A 4/1994 Heins et al.
5,331,957 A 7/1994 Liu
5,353,789 A 10/1994 Schlobohm
5,357,947 A 10/1994 Adler
5,372,130 A 12/1994 Stern et al.
5,404,874 A 4/1995 Meier
5,411,021 A 5/1995 Gdulla et al.
5,411,057 A 5/1995 Pouchot
5,413,097 A 5/1995 Birenheide et al.
5,427,092 A 6/1995 Shiao
5,450,844 A 9/1995 Kolbe et al.
5,478,377 A 12/1995 Scavnicky et al.
5,503,141 A 4/1996 Kettl et al.
5,505,197 A 4/1996 Scholey
5,535,736 A 7/1996 Jzaw
5,579,761 A 12/1996 Yuschak et al.
5,592,937 A 1/1997 Freund
5,595,173 A 1/1997 Dodd, Jr.
5,619,989 A 4/1997 Kruger
5,628,308 A 5/1997 Harges, Jr. et al.
5,640,952 A 6/1997 Swann et al.
5,647,356 A 7/1997 Osendorf et al.
5,651,810 A 7/1997 Flaherty et al.
5,660,173 A 8/1997 Newton
5,669,375 A 9/1997 Dahrendorf et al.
5,732,695 A 3/1998 Metzger
5,766,286 A 6/1998 Flaherty et al.
5,766,287 A 6/1998 Flaherty et al.
5,776,213 A 7/1998 Flaherty et al.
5,782,235 A 7/1998 Muller et al.
5,794,617 A 8/1998 Brunell et al.
5,797,974 A 8/1998 Flaherty et al.
5,875,775 A 3/1999 Nur et al.
5,924,420 A 7/1999 Reischel et al.
5,964,218 A 10/1999 Smith et al.
6,016,804 A 1/2000 Gleason et al.
6,044,842 A 4/2000 Pereira et al.
6,050,262 A 4/2000 Jay
6,055,983 A 5/2000 Metzger
6,146,449 A 11/2000 Lee et al.
6,176,239 B1 1/2001 Grove et al.
6,216,693 B1 4/2001 Rekow et al.
6,277,178 B1 8/2001 Holmquist-Brown et al.
6,298,849 B1 10/2001 Scholey et al.
2001/0013347 A1 8/2001 Rekow et al.

* cited by examiner

PROTECTIVE HOOD RESPIRATOR

BACKGROUND OF INVENTION

1. Field of Invention

This invention relates to respiratory protective systems, and more particularly to an advanced protective respiratory hood for protecting a wearer from contaminants including, but not limited to nuclear, chemical, biological, smoke and dust.

2. Background of the Invention

Devices that clean the air as it is drawn or forced through one or more filters are known as air purifying respirators (herein "APRs"). Standard APRs utilize a negative pressure system in which contaminated air is pulled through a filter upon inhalation, allowing the wearer to breathe clean, filtered air. A full-face mask pertains to protective masks which protect the wearer's eyes, face, and lungs from contamination. A half-face mask or half-mask does not protect the eyes, upper face and forehead. Rather, it is generally known in the art as a triangular-shaped cup that covers the mouth and nose of the wearer. Chemical resistant hoods protect the wearer against chemical agents such as "liquid mustard" which can cause severe burns to the head and neck. Hooded respirators are generally secured around the circumference of the neck and benefit from enhanced protection of the head area.

Military organizations, such as the U.S. Army, consistently place a number of objectives high on their list for respiratory protective devices. With soldiers carrying more equipment, there is an emphasis on reducing weight and bulk whenever possible. While full-face masks provide good protection to the wearer, they are difficult to compactly store and transport. Half-mask designs are more compact, but they do not protect the eyes, ears and head of the wearer from airborne contaminants.

Another need in both military and non-military operations is excellent outward visibility. Masks and hoods that fog due to accumulation of carbon dioxide and moisture from exhaled air severely inhibit a solider from successfully completing his mission. Furthermore, many designs have filters and other structures that encumber a soldier's ability to sight a weapon or which may be snagged on other equipment.

Another need exists for a mask or hood that remains engaged during sudden movement. A number of designs, particularly those with a single filter, are subject to substantial torque when a wearer moves his head suddenly because the mass of the device is not equally distributed about the axis of the rotation for the wearer. This can cause the protective seal of the device to become disengaged, and thus the protection factor is compromised.

Another need exists for a device that uses readily available filtration media. Many designs in the prior art utilize proprietary filters which are solely intended to operate with a single design of respiratory protective device. This increases the manufacturing, quality control and inventory overhead for supporting the devices.

Another need exists for a protective hood respirator with improved verbal communication. Mouth-piece respirators are generally not acceptable where verbal communication is required as the mouth-piece must be disengaged to speak. Half-mask and full-face masks do permit verbal communication as they generally employ a cup that surrounds the mouth and nose.

Accordingly, what is needed in the art is a respiratory device that stores in a compact unit, provides substantially fog-free, unencumbered outward visibility, is stable and stays engaged to the wearer, even during violent movements, utilizes off-the-shelf filtration media, and provides verbal and drinking capability.

It is, therefore, to the effective resolution of the aforementioned problems and shortcomings of the prior art that the present invention is directed.

However, in view of the prior art in at the time the present invention was made, it was not obvious to those of ordinary skill in the pertinent art how the identified needs could be fulfilled.

SUMMARY OF THE INVENTION

The present invention comprises protective respiratory apparatus having a neck-sealable hood adapted to enclose the head of a wearer, the hood having an interior and an exterior. It is preferred that the hood be constructed of an elastomeric material such as butyl rubber or neoprene. Although fabric-type materials have been successfully employed in protective hoods in the past, elastomeric material is substantially quieter which may be particularly critical in military and law enforcement operations.

At least one filter is sealingly secured to the hood wherein air passing from the outside of the hood to the inside of the hood is filtered of contaminants. However, it is preferred that two filters be employed in symmetrical relation to the hood, and more specifically in the area proximate to the location of the wearer's mouth and nose would be. The dual filter design has a number of advantages which include better outward vision in comparison to large, bulky center-mounted filters, lower breathing resistance, and better distribution of mass wherein less torque is suffered from sudden head movements due to the more equal distribution of weight. Still another advantage of the dual filter design is its ability to compact in tight relation, particularly when used with a flexible hood and half-mask.

The filters are sealed to the hood about the periphery of the filters. In one embodiment of the invention, the filters are fitted substantially flush with the exterior of the hood. The advantage to this configuration is that the bodies of the filters do not interfere with the operations of the wearer or get snagged on other equipment.

A half-mask cup adapted to sealingly cover the nose and mouth of the wearer is positioned inside the hood. The half-mask cup is mechanically, but not fluidly coupled to the filters. Accordingly, filtered air is not immediately drawn into the half-mask cup, but into the interior of the hood. It should be noted that while the half-mask cup is a preferred breathing interface for the invention, additional breathing interfaces may also be employed including, but not limited to, full-face masks and mouth-piece interfaces. A coupling part interconnects the filter to the half mask cup, the coupling part being imperforate so that it is impervious to fluid flow. A filtration part of the filter is pervious to fluid flow and is disposed radially outward from the coupling part. The fluid flow follows a path of travel through the filtration part, into the interior of the hood, flowing over the visor and into the half mask cup. The filter is therefore understood to be mechanically coupled to the half mask cup and fluidly coupled to the interior of the hood.

At least one air intake valve is integrated in the cup wherein filtered air resident in the interior of the hood is drawn into the half-mask cup for respiration by the wearer. A flexible and substantially transparent visor, preferably constructed of flexible urethane, is sealingly engaged to the hood and adapted to provide outward vision for the wearer. Preferably, the at least one air intake valve in the cup is located proximate to the nose bridge of the wearer whereby filtered air resident in the interior of the hood is drawn across the visor and into the at least one air intake valve responsive to inhalation by the wearer. The advantage of this configuration is that carbon dioxide and humidity, the primary culprits in visor fogging, are substantially reduced or eliminated by the air flow path across the visor.

In another embodiment of the invention, the hood includes at least one convexity disposed in outward relation from the interior of the hood analogous to a finger on a glove. The convexity has an axis of symmetry substantially similar to an individual filter. An aperture coincident with the axis of symmetry slideably receives and secures a filter by compressive interference fit. It is worthy to note this advancement over the prior art wherein past apertures were simply formed by a die cut on a two-dimensional plane. By forming the finger-like projection, the surface area seal between the elastomeric hood and the filter is overwhelmingly increased with a substantial benefit in the overall protection factor of the device. An alternative to this embodiment is to employ a concavity disposed in inward relation to the interior of the hood rather than a convexity disposed in outward relation.

In a preferred embodiment of the invention, a filter interface is sealingly attached about its periphery to the hood and substantially rigidly secured to the cup. The filter interface is adapted to screw threadably receive the at least one filter. An elastomeric gasket is sandwiched between the filter interface and the at least one filter to further provide a fluid-tight seal. An advantage of creating a filter interface is that the at least one filter is user-replaceable and the entire system lends itself to re-use and decontamination.

Alternatively, the at least one filter is slideably received by the filter interface and fluidly secured by a retention grill screw threadably received by the filter interface, the retention grill adapted to retain the at least one filter in sealing engagement with the filter interface. A visual indicator is provided to show when a complete engagement of the retention grill to the filter interface has been achieved. Preferably, the retention grill is provided in a binary engagement wherein it is clearly engaged or disengaged in Boolean relation—unlike a screw of a filter that has an infinite number of positions, some of which may allow for leakage between the screw threads.

The filter interface may further comprise flanges about its periphery which are sonically welded to the hood. In yet another embodiment of the filter interface may comprise a two-piece configuration, an inner portion substantially rigidly secured to the cup in the interior of the hood and an outer portion positioned in mirrored relation to the inner portion whereby the inner and outer portion are sonically welded together about their peripheries, sandwiching at least a portion of the hood therebetween to form a fluid-tight seal.

It should be noted that in a preferred embodiment of the invention the mechanical coupling of the cup to the at least one filter is fluid-tight. However, the present invention anticipates an embodiment wherein the mechanical coupling of the cup to the at least one filter is adapted to permit partial flow of air from the filter into the cup and partial flow of air from the filter into the interior of the hood. An alternative embodiment of the invention may include a split-flow configuration wherein at least one secondary filter is dedicated to full or partial fluid communication with the cup.

For extended wear in hazardous conditions, a conduit from the exterior of the hood into the cup may be provided whereby the wearer can drink fluids without removing the hood. Furthermore, it is preferred that a tension strap substantially encircling the exterior of the hood and attached to the filters or other hard-point on the exterior of the hood be provided whereby the cup is biased against the face of the wearer. Alternatively, the tension strap may be positioned in the interior of the hood.

It is important to remain cognizant that, without proper design features, unfiltered air may be introduced into the cup through the exhalation pathway. Accordingly, a preferred embodiment of the invention includes an exhalation valve mated to the cup, a baffling means in fluid communication with the exhalation valve wherein exhaled air exits the cup through the exhalation valve, through the baffling means and out into the atmosphere. The baffling means provides a buffer quantity of filtered, exhaled air as a protective barrier against unfiltered air. It is also preferred that the air intake valve and the exhalation valve be constructed as one-way check valves. To provide replacement functionality for the filters, it is preferred that they are screwably coupled to the cup, but still not fluidly coupled as that would defeat the anti-fog objectives of the air pathway.

In order to provide the optimum integration between hood and filter, a method of fabricated the hood is provided which includes the steps of forming an elastomeric hood by a dipping process having at least one convexity having an axis of symmetry, cutting at least one aperture coincident with the axis of symmetry and securing a filter by compressive interference fit within the aperture. It is advantageous to predetermine the circumference of the filters and cut the apertures to a circumference smaller than the circumference of the filters. This insures the tight, compressive fit between hood and filters. It is also preferred that the dipping process include pre-molding outline ridges of the visor, the apertures and the exhalation valve opening wherein die cutting along the outline ridges provides a substantially more efficient and precise assembly.

An advantage of the present invention is that the combination of half-mask, hood and dual filters permits the overall unit to be tightly packaged in a compact container. The half-mask is typically constructed of a resilient, elastomeric material which bends to move the filters in mirrored relation to each other. The flexible hood and visor then wraps around the half-mask and filters to form a compact design for storage, transport and carry.

An advantage of the half-mask configuration over mouth-sealable devices is that it permits better verbal communication and drink capability. Mouth-sealable devices, while enjoying a high protection factor, have limited wear times as wearers must disengage the mouth seal to drink liquids. In addition, verbal communication cannot be initiated without disengaging the mouth seal and, thus, diminishing the protection factor afforded by the mouth seal.

Still another advantage of the present invention is that inhaled air, previously flowing from the filter to the half-mask in the prior air, now flows into the hood first, passes over the transparent visor, then flows into the half-mask for respiration.

Still another advantage of the present invention is that convexities in the hood provide a tight, finger-like seal for the filters. Rather than simply sealing to the protective hood on a single plane, the filters are compressively engaged by an interference fit in three dimensions with a much greater surface area in contact than known in the prior art.

It is to be understood that both the foregoing general description and the following detailed description are explanatory and are not restrictive of the invention as claimed. The accompanying drawings, which are incorporated in and constitute part of the specification, illustrate embodiments of the present invention and together with the general description, serve to explain principles of the present invention.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF DRAWINGS

For a fuller understanding of the nature and objects of the invention, reference should be made to the following detailed description, taken in connection with the accompanying drawings, in which.

DETAILED DESCRIPTION

Figure 1:
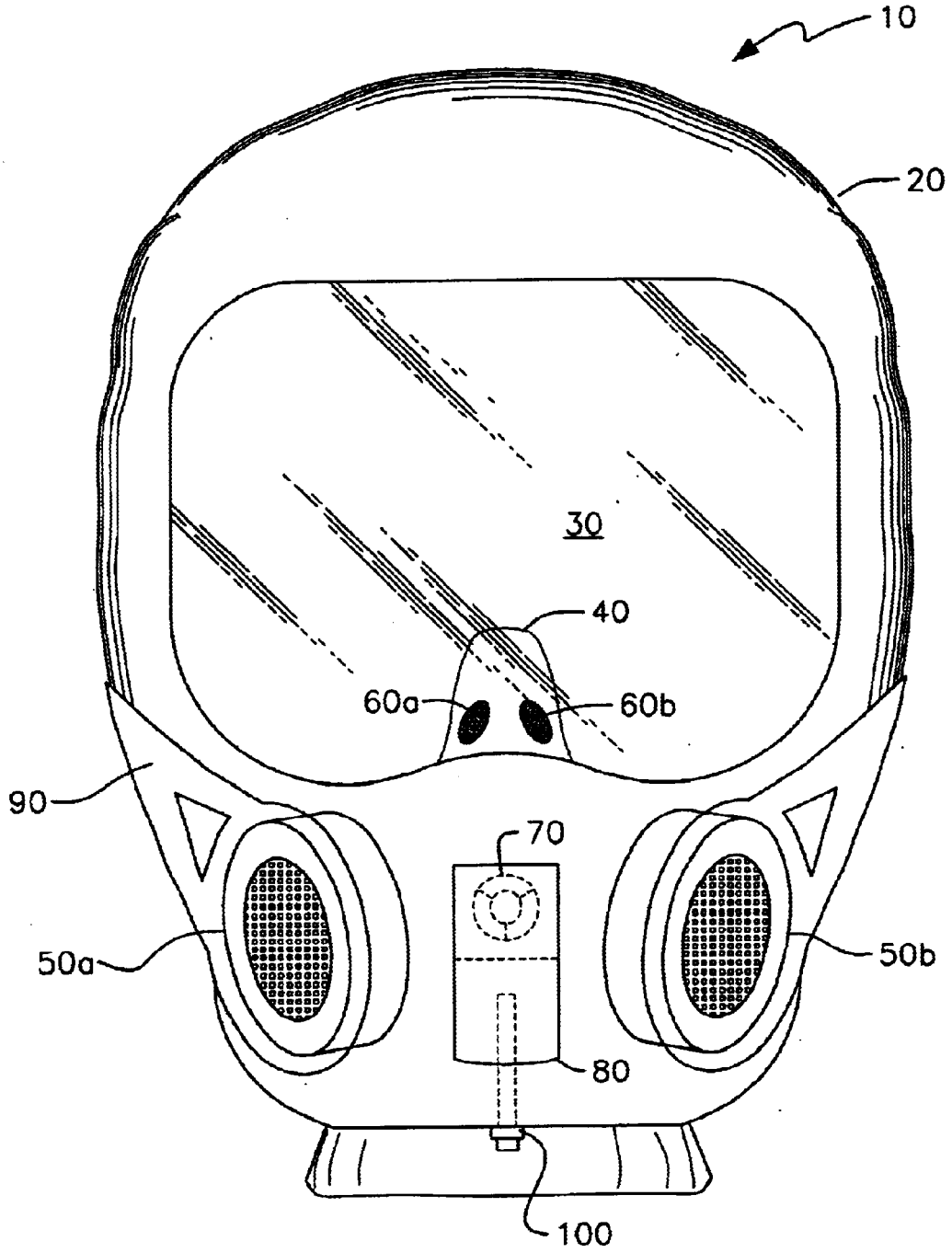
FIG. 1 is a partially sectional, front elevated view of the invention.
Figure 2:
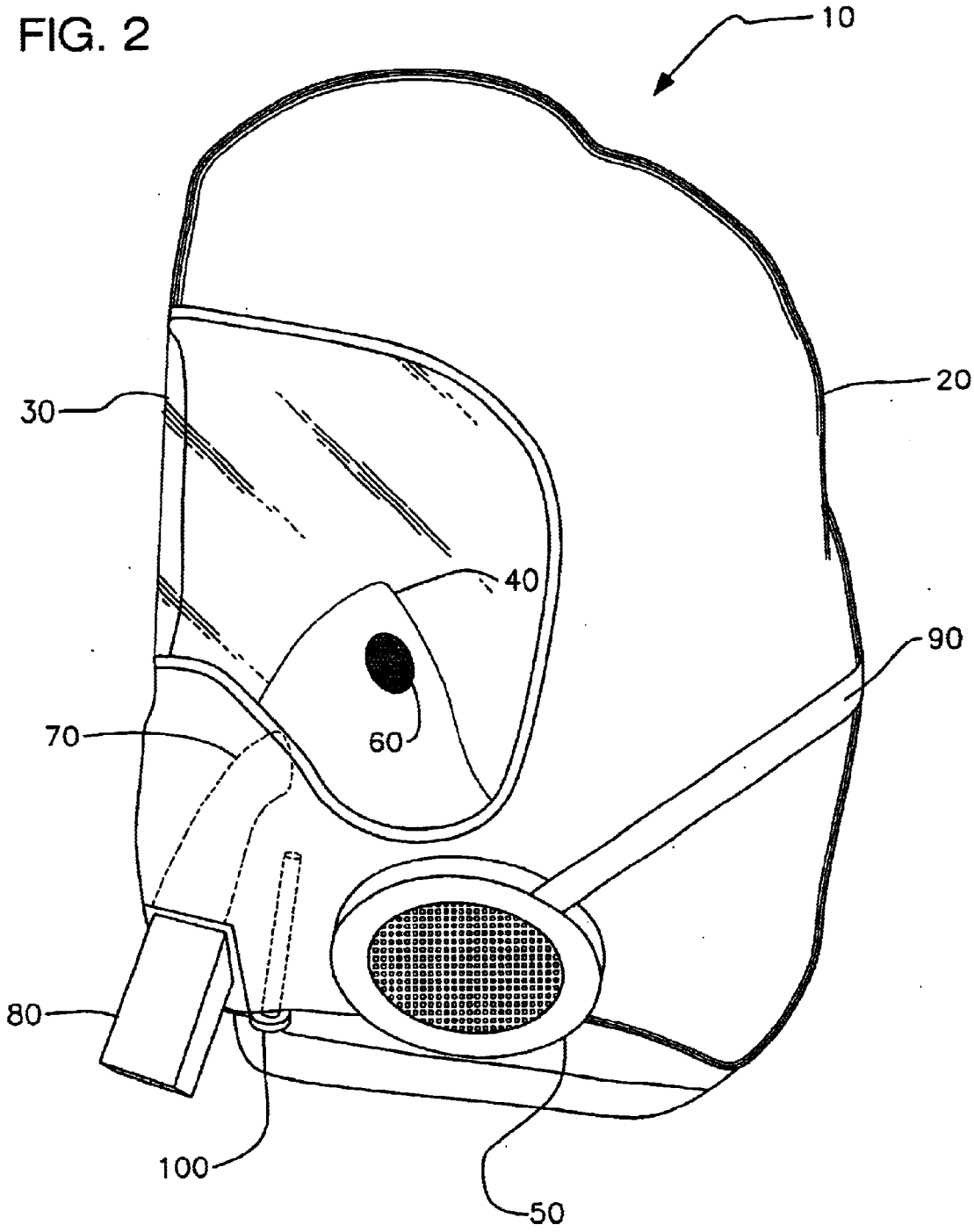
FIG. 2 is a partially sectional, side elevated view of the invention.

FIGS. 1–2 show the protective respiratory apparatus denoted as a whole by numeral 10. A substantially airtight hood encloses the head of the wearer. A flexible, transparent urethane visor provides outward visibility. A half-mask cup 40 inside the hood 20 is sealingly engaged to the face of the wearer to over the nose and mouth.

The cup is mechanically, but not fluidly coupled to the filters 50*a–b*. The air intake valves 60*a–b* in the cup drawn filtered air resident in the hood across the visor 30 and into the half-mask cup 40 for respiration by the wearer. An exhalation valve 70 mated to the cup 40 is provided in fluid communication with a baffling means 80 wherein exhaled air exits the cup 40 through the exhalation valve 70 and through the baffling means 80 to the outside atmosphere. The exhalation valve 70 and air intake valves 60*a–b* are one-way check valves to prevent the backflow of air in the wrong direction. A tension strap 90 about the exterior of the hood 20 is attached to each filter 50*a–b* whereby the cup 40 is biased against the face of the wearer to maintain a substantially airtight seal. A conduit 100 from the exterior of the hood 20 into the cup 40 is provided whereby the wearer can drink fluids without removing the hood 20 or disengaging the cup 40.

Figure 3:
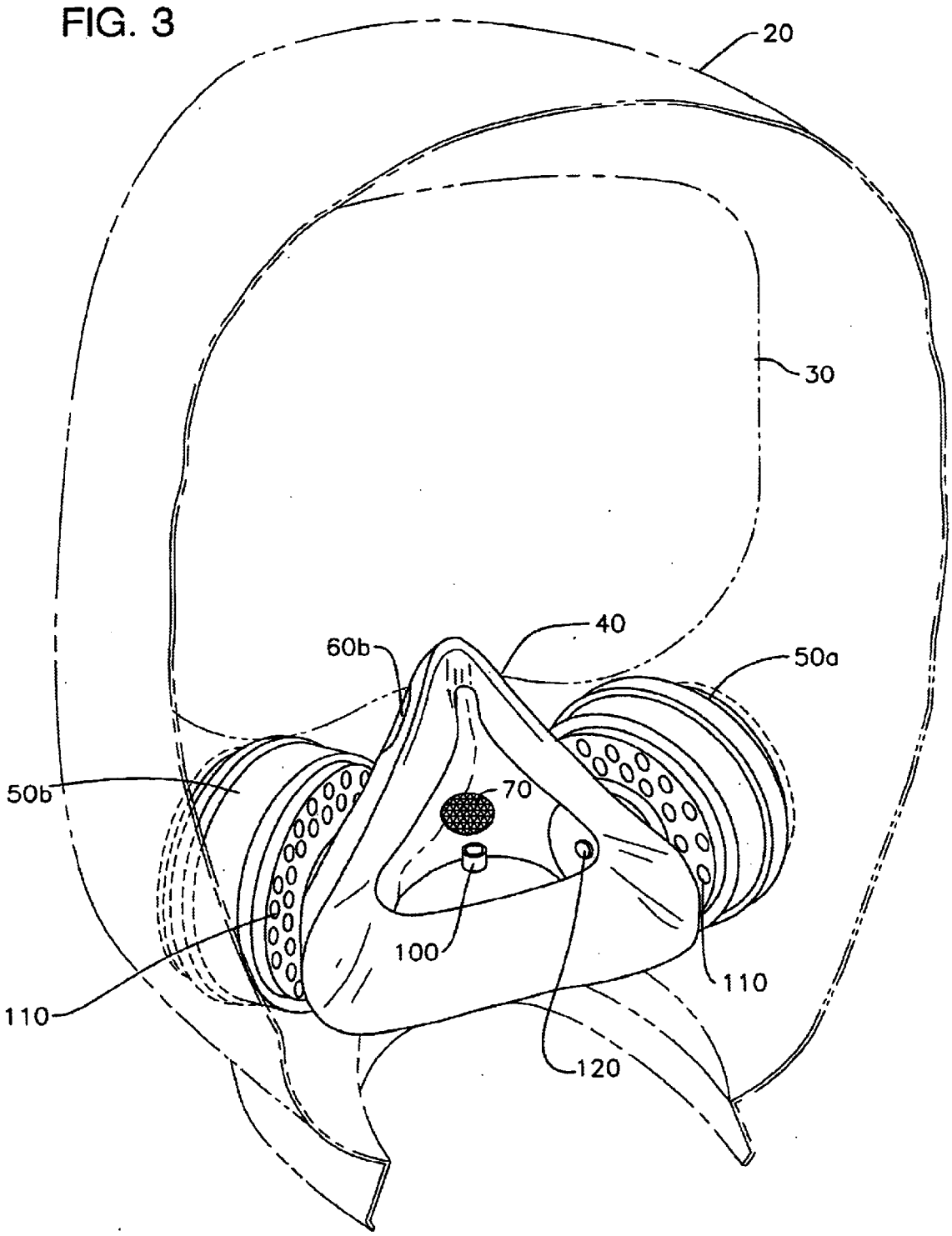
FIG. 3 is a partially sectional view of the invention looking outward from the inside of the protective hood.

FIG. 3 illustrates a view from the inside of the protective hood looking outward. The hood 20 is shown to seal around the filters 50*a–b* about their periphery. A mechanical coupling 120 secures the filters 50*a–b* to the cup 40, but does not permit air to flow through. Rather, apertures 110 formed in the reverse side of the filters 50*a–b* permit filtered air to accumulate with in the hood 20. Then, the filtered air is drawn across the transparent visor 30 then into the inhalation valve 60*b* for respiration within the cup 40. When a vacuum is experienced, as the wearer inhales within the cup 40, the one-way inhalation check valve 60*b* is open, but the one-way exhalation check valve 70 is closed. During exhalation, a plenum is produced within the cup 40 closing the inhalation check valve 60*b* and opening the exhalation check valve 70.

Figure 4:
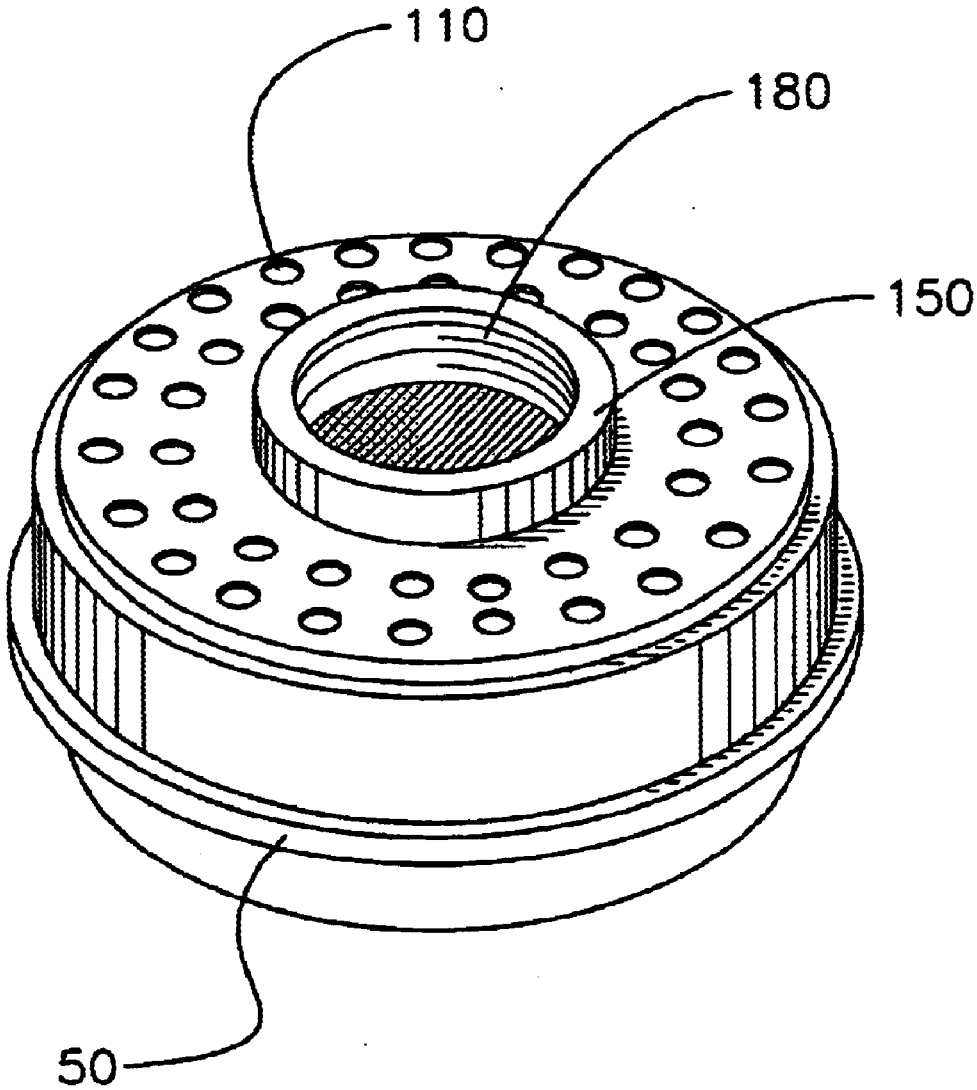
FIG. 4 is a view of the filter media.

As noted previously, a benefit of the present invention is that it uses off-the-shelve filter media such as the SURVAIR 1058 NIOSH brand cylindrical filter. FIG. 4 shows the apertures 110 formed into the rear of the filter 50 to permit filtered air to enter the interior of the hood 20. In one embodiment of the present invention, the attachment point 220 does not allow a fluid coupling and is adapted to permit filtered air to enter the interior of the hood 20 and not directly into the half-mask cup 40. In another embodiment of the present invention, the attachment point 220 is comprised of a material that does allow for fluid coupling and is adapted to permit partial airflow into the cup into the interior of the hood. Threads 180 permit the filter 50 to be screwably coupled to the cup 40.

Figure 5:
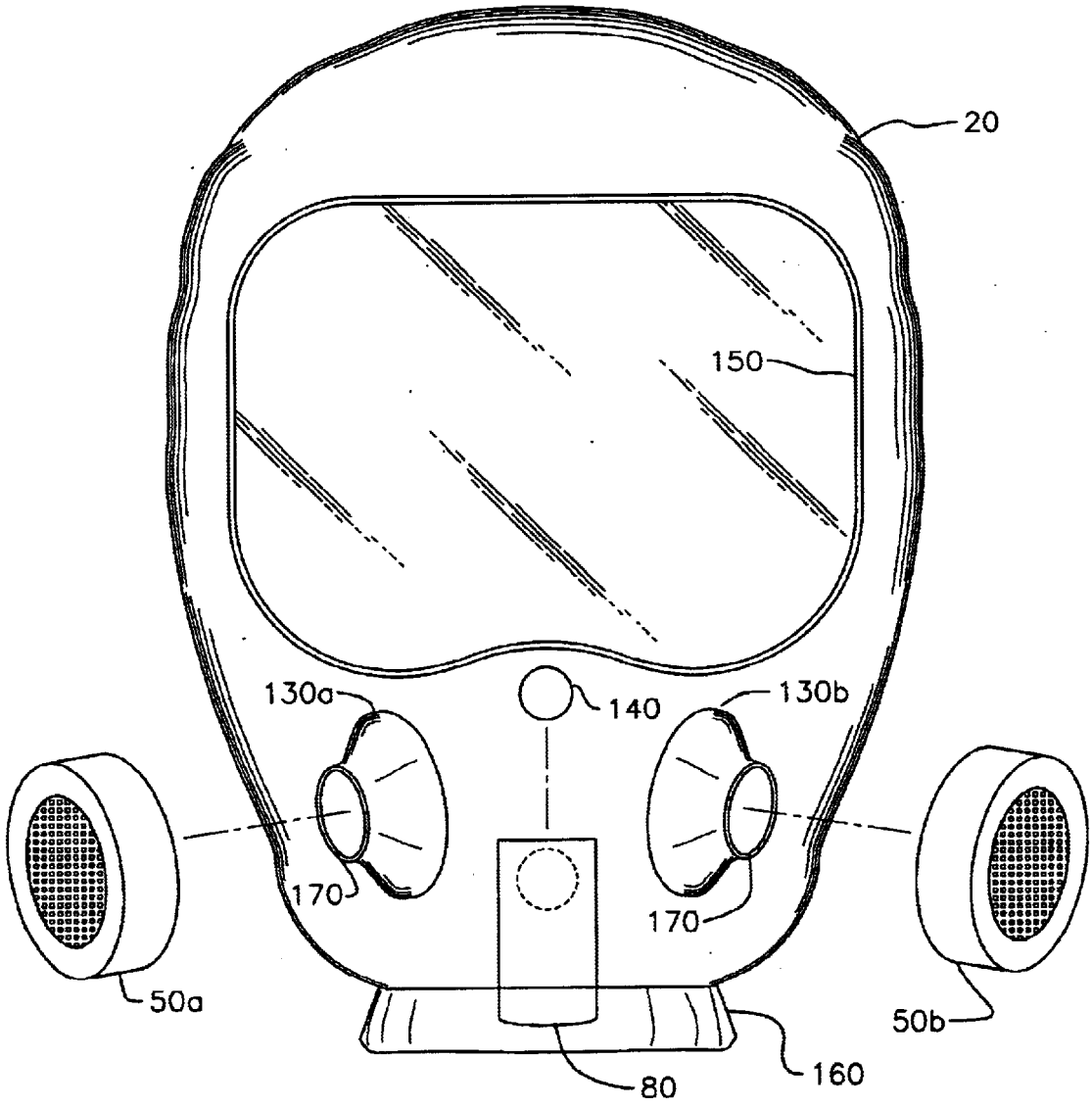
FIG. 5 is a partially sectional, elevated view of the assembly process according to a first embodiment of the invention.
Figure 6:
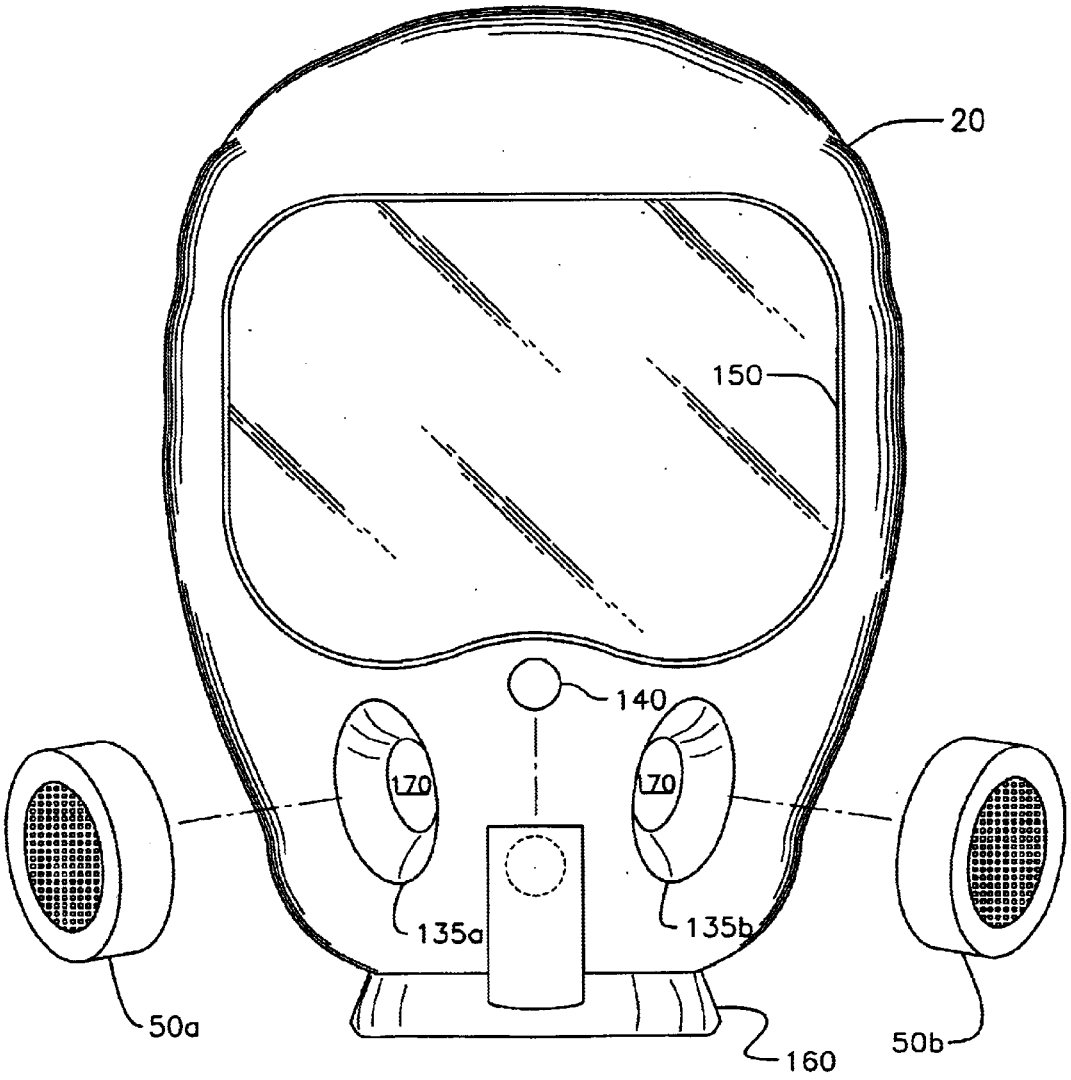
FIG. 6 is a partially sectional, elevated view of the assembly process according to a second embodiment of the invention.

FIG. 5 illustrates a method of fabricating the hood wherein the dipping process forms convexities 130*a–b* in the hood which are finger-like projections similar to a glove. Apertures 170 are formed coincident wit the axis of symmetry of the convexities and the filters 50*a–b* are pushed into the apertures 170 to form a compressive interference fit with the apertures. In order to provide a snug fit, the apertures 170 have a lesser circumference than that of the corresponding filters 50*a–b* which are received therein. Another advantage of this dipping process is that outlines of the visor 30 may be formed by raised ridges to enable more precise and as efficient die cutting. FIG. 6 is a second embodiment of the fabricating method wherein concavities 135*a–b* are substituted for the convexities of FIG. 5. It should also be noted that the dipping process also forms an exhalation aperture 140 which is coupled to the baffling means 80. In addition, a neck dam 160 is integrally formed to maintain a high protection factor for the apparatus. The one-piece dipped hood enjoys substantially higher reliability as it lacks seams that could be subject to opening or ripping.

Figure 7:
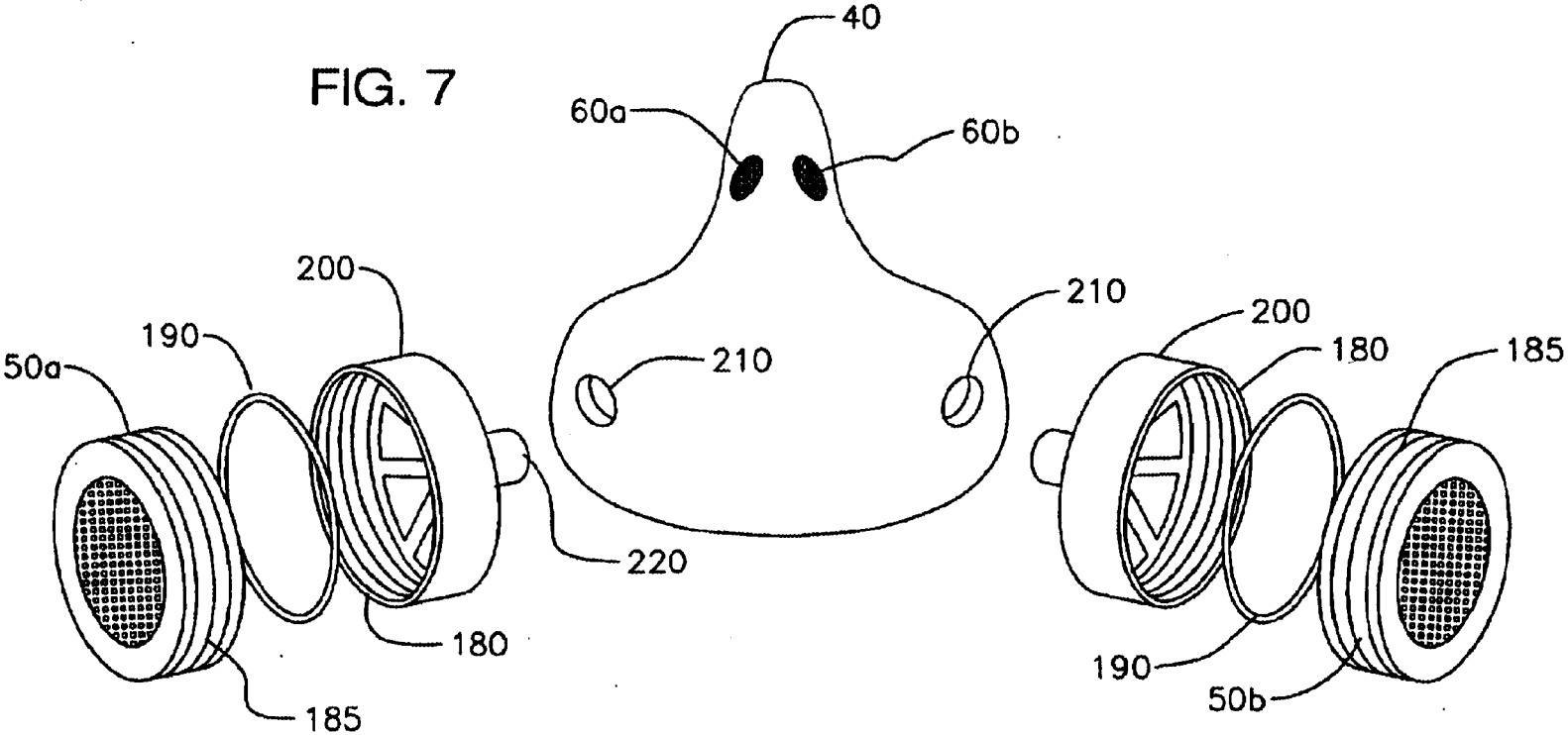
FIG. 7 is an exploded, elevated view of the filter interface assembly to the cup.
Figure 8:
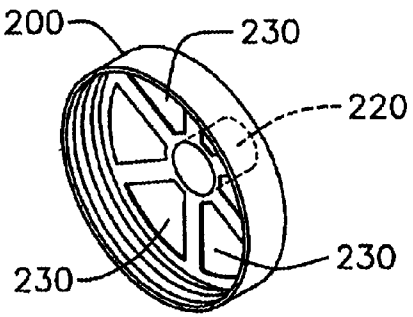
FIG. 8 is an elevated view of the filter interface.

In FIG. 7, filter interface 200 having attachment point 220 is secured to cup 40 at receiving point 210. Filters 50*a–b* have filter threads 185 which interface with interface threads 180. Gasket 190 is sandwiched between filters 50*a–b* and filter interface 200. FIG. 8 shows a details of filter interface

200 wherein apertures 230 permit filtered air to pass directly into the interior of hood 20 while attachment point 220 is mechanically, but not fluidly coupled to cup 40.

Figure 13:
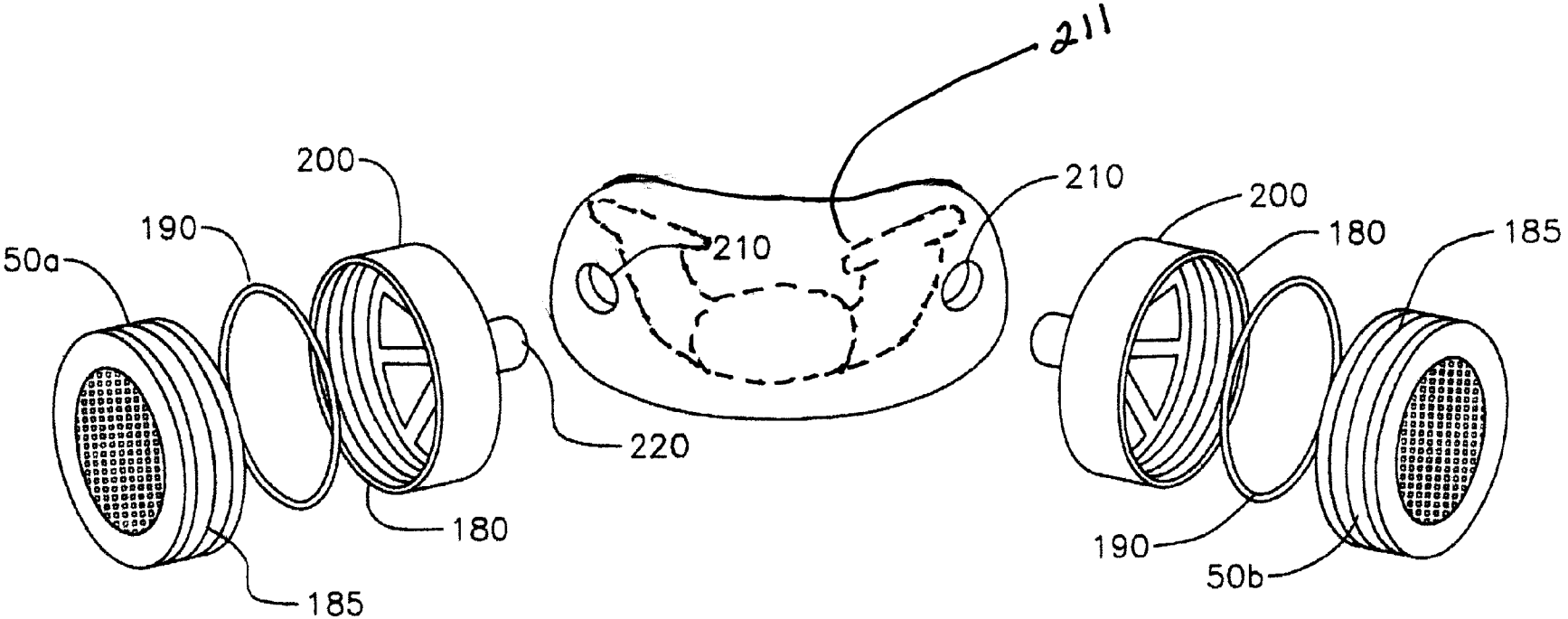
FIG. 13 is an exploded, elevated view of the filter interface assembly to the breathing interface.

FIG. 13 illustrates an embodiment of the invention as described with regard to FIG. 7, wherein a mouthpiece 211 replaces the cup 40. The filter interface 200 having attachment point 220 is secured to the mouthpiece.

Figure 9:
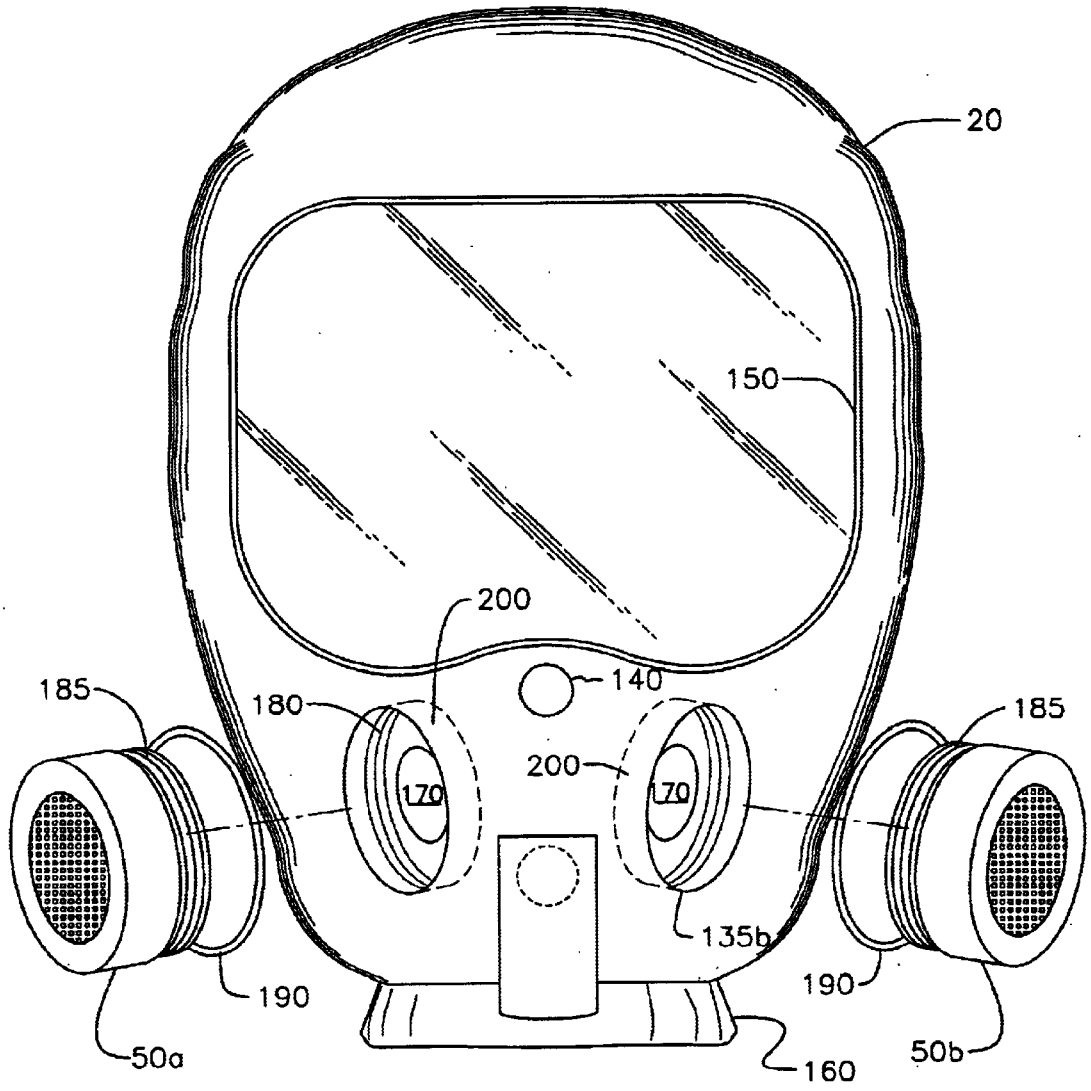
FIG. 9 is a partially sectional, elevated view of an embodiment of the invention employing the filter interface.
Figure 10:
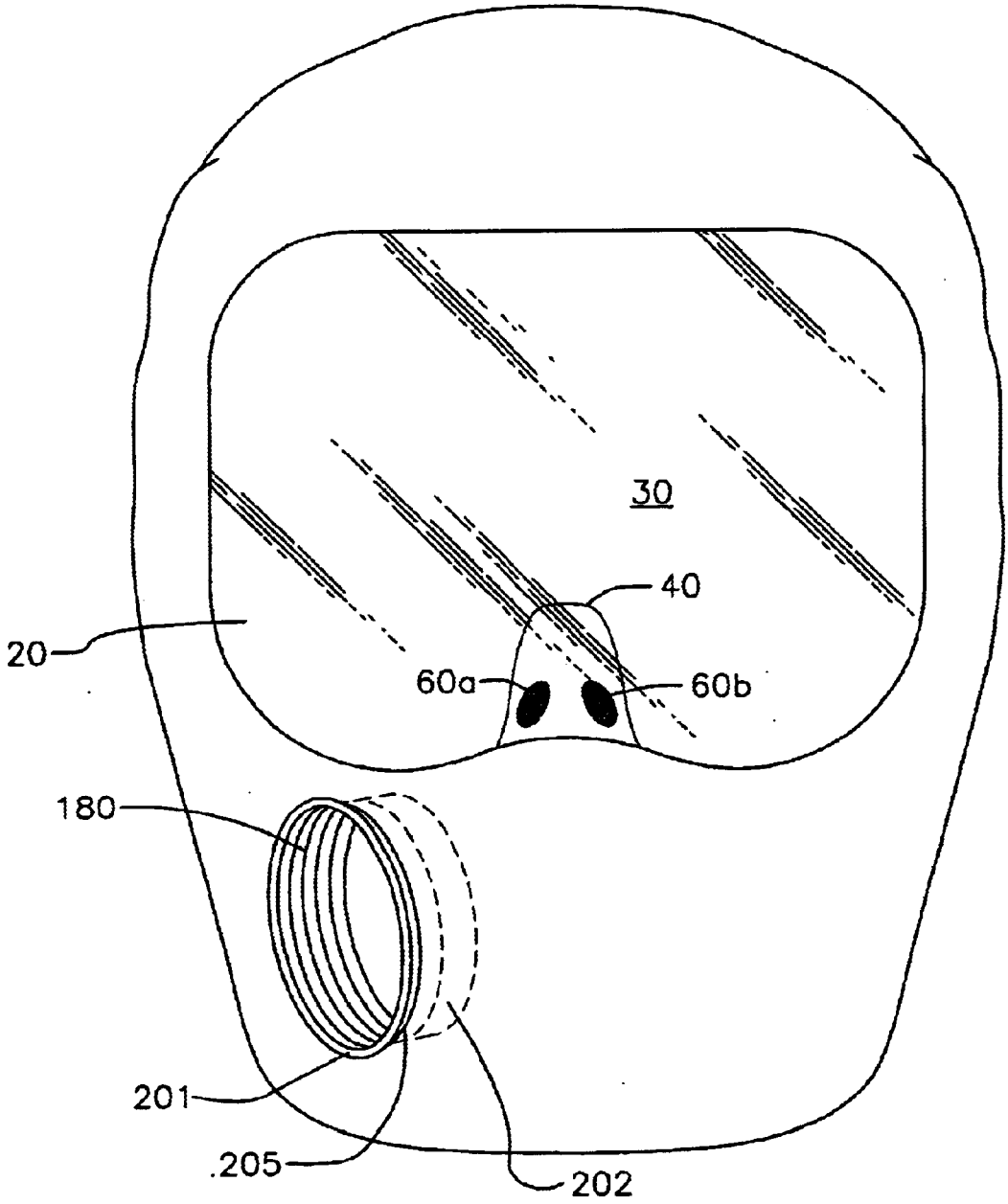
FIG. 10 is a partially sectional, elevated view of an alternative embodiment of the filter interface having inner and outer portions.

FIG. 9 illustrates an assembly of the hood wherein filter interface is recessed to the interior of hood 20 and screw threadably receives filters 50*a–b* . Gasket 190 is sandwiched between filters 50*a–b* and filter interface 200. FIG. 10 illustrates an assembly of an embodiment of the invention employing two-piece filter interface comprising outer portion 201 and inner portion 202 .Both portions sandwich hood 20 and are sonically welded about periphery 205.

Figure 12:
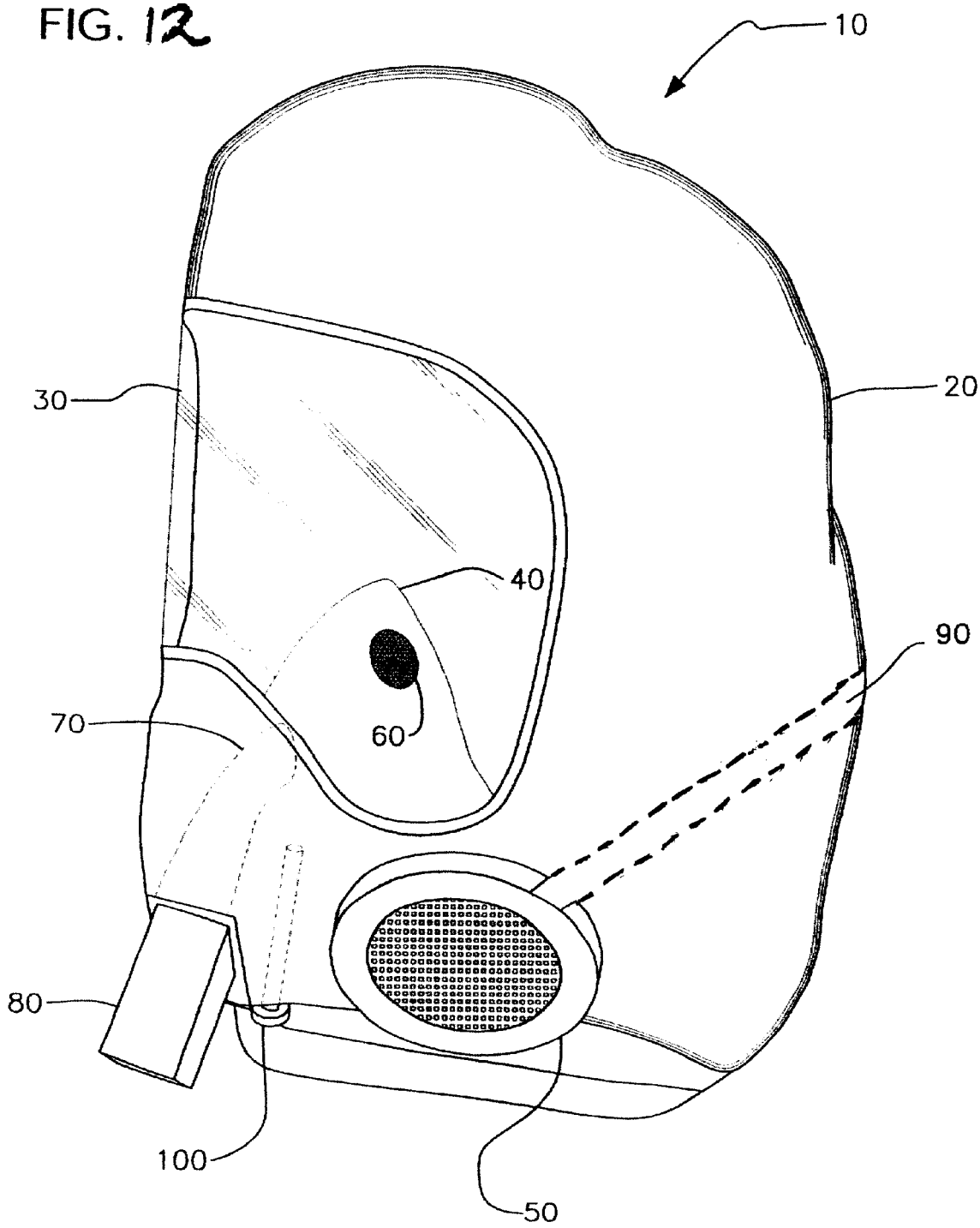
FIG. 12 is a partially sectional, elevated view of an embodiment of the invention employing the filter interface and a tension strap internal to the hood.

FIG. 12 illustrates an embodiment of the invention as described with regard to FIG. 2 wherein the tension strap 90 exists within the interior of the hood 20 and is attached to each filter 50*a–b* whereby the cup 40 is biased against the face of the wearer to maintain a substantially airtight seal.

Figure 11:
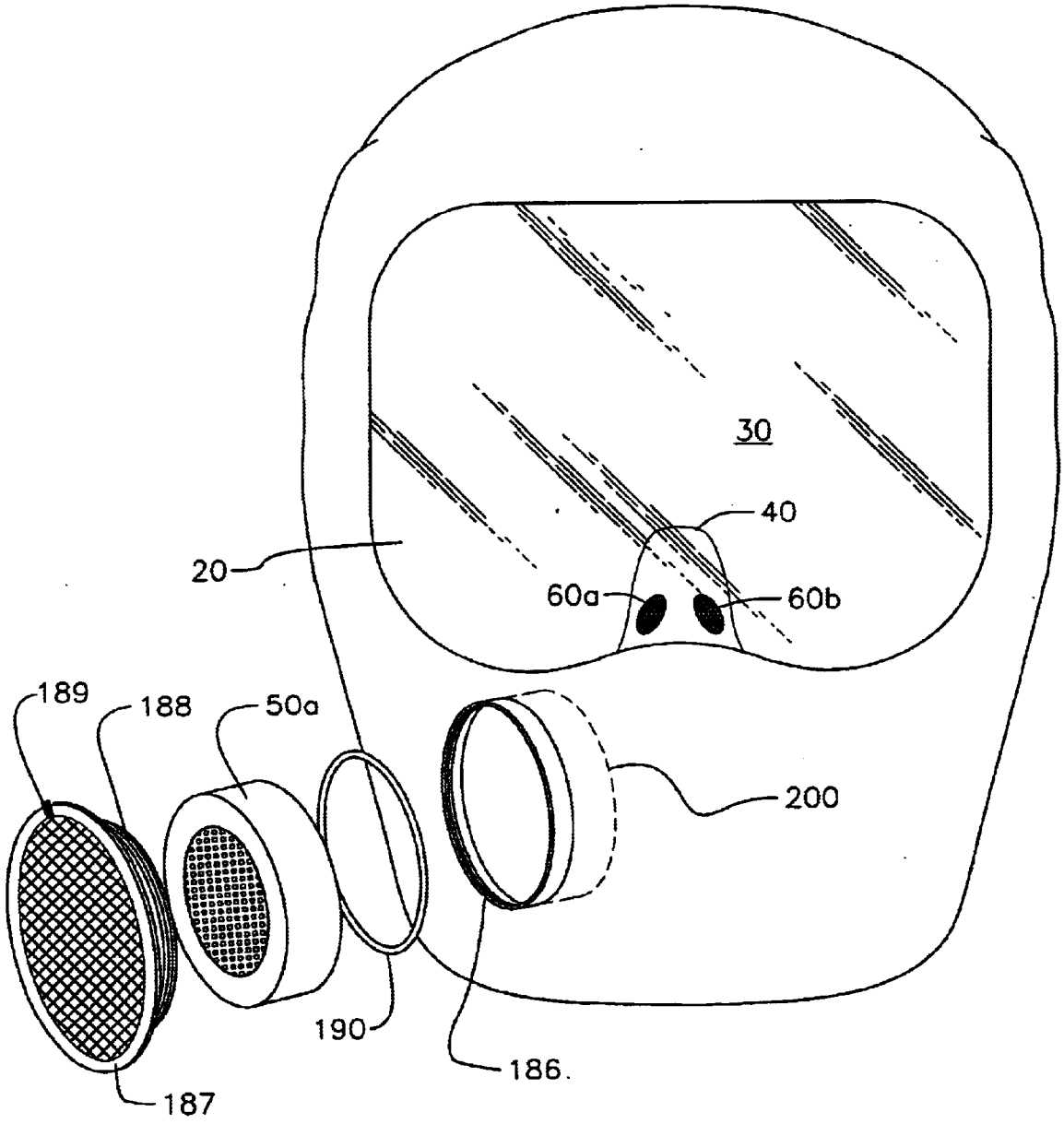
FIG. 11 is a partially sectional, elevated view of an alternative embodiment of the invention wherein a retention grill retains the at least one filter in the filter interface.

FIG. 11 illustrates an embodiment of the invention wherein the at least one filter 50*a* is slideably received by filter interface 200 and retained by retention grill 187 screw threadably received by filter interface 200. Threads 188 on retention grill 187 are received by threads 186 on filter interface 200. To provide confirmation that retention grill 187 is positively engaged, a visual indicator 189 is provided on retention grill 187 to show a rotational stop point corresponding with a fully threaded state. Preferably, a binary locking interface may be provided to confirm engagement or disengagement of retention grill 187 with filter interface 200.

It will be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween. Now that the invention has been described.

What is claimed is:

1. A protective respiratory apparatus comprising:

a neck-sealable hood adapted to enclose the head of a wearer, the hood having an interior and an exterior, a transparent visor formed in said hood;

said transparent visor providing a viewing window for said wearer;

a half mask cup positioned in said interior of said hood;

a filter mounted in said hood;

part of the filter being disposed exterior to said hood and part of the filter being disposed in the interior of the hood;

the filter having a filtration part that is pervious to fluid flow and a coupling part that is impervious to fluid flow, said filtration part being disposed radially outwardly of the coupling part;

the fluid flow following a path of travel through the filtration part, into the interior of the hood, flowing over the visor, and into the half mask cup;

whereby the filter is directly attached but not fluidly coupled to the half mask cup; and whereby the filter is fluidly coupled to the interior of the hood.

2. The apparatus of claim 1 further comprising a filter interface sealingly attached about its periphery to the hood and substantially rigidly secured to the half mask cup, the filter interface adapted to sealingly receive the filter.

3. The apparatus of claim 2 wherein the filter interface further comprises:

an inner portion adapted to abut the interior of the hood and be substantially rigidly secured to the half mask cup;

an outer portion adapted to abut the exterior of the hood in mirrored relation to the inner portion whereby the inner and outer portions are sonically welded together about their peripheries.

4. The apparatus of claim 2 wherein the filter is screw threadedly received by the filter interface.

5. The apparatus of claim 2 further comprising a retention grill screw threadedly received by the filter interface, the retention grill adapted to retain the filter in sealing engagement with the filter interface.

6. The apparatus of claim 5 further comprising a visual indicator on the retention grill adapted to show when a complete engagement of the retention grill to the filter interface has been achieved.

7. The apparatus of claim 2 further comprising a retention grill adapted to secure the filter to the filter interface in binary engagement wherein it is positively engaged or disengaged.

8. The apparatus of claim 1 further comprising a conduit from the exterior of the hood into the cup whereby the wearer can drink fluids without removing the hood.

9. The apparatus of claim 1 further comprising at least one tension strap substantially encircling the exterior of the hood and attached to the filter whereby the half mask cup is biased against the face of the wearer.

10. The apparatus of claim 1 further comprising at least one tension strap substantially lining the interior of the hood and attached to the filter whereby the half mask cup is biased against the face of the wearer.

11. The apparatus of claim 1 further comprising a secondary filter in direct fluid communication with the half mask cup.

12. A protective respiratory apparatus comprising:

a neck-sealable hood adapted to enclose the head of a wearer, the hood having an interior and an exterior;

a transparent visor formed in said hood;

said transparent visor providing a viewing window for said wearer;

a half mask cup positioned in said interior of said hood;

a filter mounted in said hood;

part of the filter being disposed exterior to said hood and part of the filter being disposed in the interior of the hood;

the filter having a filtration part that is pervious to fluid flow and a coupling part that is partially impervious to fluid flow, said filtration part being disposed radially outwardly of the coupling part;

the fluid flow passing through said filter dividing into a split path of travel where a first part of said fluid flow flows through the filtration part into the interior of the hood and over the visor in a quantity sufficient to inhibit fogging of the visor, and then into the half mask cup, and a second part flows through the coupling part and directly into the half mask cup;

whereby the filter is directly attached to the half mask cup; and whereby the filter is fluidly coupled to the interior of the hood.

13. The apparatus of claim 12, further comprising:

a secondary filter mounted in said hood;

said secondary filter having a filtration part that is pervious to fluid flow and a coupling part that is partially impervious to fluid flow, said filtration part being disposed radially outwardly of the coupling part;

the fluid flow passing through said secondary filter dividing into a split path of travel where a first part of said fluid flow flows through the filtration part of said secondary filter into the interior of the hood and over the visor in a quantity sufficient to inhibit fogging of the visor, and then into the half mask cup, and where a second part passing through said secondary filter flows through the coupling part and directly into the half mask cup.

* * * * *